US008083324B2

(12) United States Patent
Kwon et al.

(10) Patent No.: US 8,083,324 B2
(45) Date of Patent: Dec. 27, 2011

(54) INKJET PRINTHEAD AND METHOD OF MANUFACTURING THE SAME

(75) Inventors: Myong-Jong Kwon, Suwon-Si (KR); Sung-Joon Park, Suwon-Si (KR); Jin-Wook Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 385 days.

(21) Appl. No.: 12/489,599

(22) Filed: Jun. 23, 2009

(65) Prior Publication Data

US 2010/0110142 A1 May 6, 2010

(30) Foreign Application Priority Data

Nov. 3, 2008 (KR) ..... 10-2008-0108471

(51) Int. Cl.
*B41J 2/135* (2006.01)
*B41J 2/16* (2006.01)

(52) U.S. Cl. ..... 347/63; 347/65; 29/890.1

(58) Field of Classification Search ..... 347/20, 347/44, 47, 54, 56, 63, 65; 29/890.1; 216/27
See application file for complete search history.

(56) References Cited

U.S. PATENT DOCUMENTS

| | | | | |
|---|---|---|---|---|
| 7,168,787 | B2 * | 1/2007 | Jung et al. | 347/47 |
| 2007/0256301 | A1 * | 11/2007 | Park et al. | 29/890.1 |
| 2008/0303869 | A1 * | 12/2008 | Park et al. | 347/54 |
| 2009/0278898 | A1 * | 11/2009 | Park et al. | 347/63 |
| 2009/0309911 | A1 * | 12/2009 | Kim | 347/14 |
| 2010/0033536 | A1 * | 2/2010 | Lee et al. | 347/47 |
| 2010/0060695 | A1 * | 3/2010 | Kwon et al. | 347/47 |
| 2010/0118088 | A1 * | 5/2010 | Park et al. | 347/47 |
| 2010/0128091 | A1 * | 5/2010 | Kwon et al. | 347/63 |
| 2010/0165044 | A1 * | 7/2010 | Park et al. | 347/40 |
| 2011/0069121 | A1 * | 3/2011 | Park et al. | 347/47 |

* cited by examiner

*Primary Examiner* — Huan Tran
(74) *Attorney, Agent, or Firm* — Staas & Halsey LLP

(57) ABSTRACT

Inkjet printheads and methods of manufacturing the inkjet printhead are disclosed. The inkjet printhead may include a glue layer disposed between the substrate and a chamber layer. The glue layer may contain a crosslink inhibitor that inhibits cross linkage of a photosensitive resin during an exposing process.

25 Claims, 15 Drawing Sheets

INKJET PRINTHEAD AND METHOD OF MANUFACTURING THE SAME

CROSS-REFERENCE TO RELATED APPLICATION

This application claims the benefit of Korean Patent Application No. 10-2008-0108471, filed on Nov. 3, 2008, in the Korean Intellectual Property Office, the disclosure of which is incorporated herein in its entirety by reference.

TECHNICAL FIELD

The present disclosure relates generally to a thermal inkjet printhead and a method of manufacturing the thermal inkjet printhead.

BACKGROUND OF RELATED ART

An inkjet printhead is a device that discharges small droplets of ink at desired locations on a printing medium through nozzles, thereby forming a visible image of one or more color. Broadly speaking, an inkjet printhead may be classified into one of two types according to the mechanism employed for discharging the ink droplets. The first type is a thermal inkjet printhead that generates bubbles in ink using a heat source, and that discharges the ink droplets by the expansive force of the bubbles. The second type is a piezoelectric inkjet printhead, which uses a piezoelectric material to discharge the ink droplets by a pressure applied to ink due to transformation of the piezoelectric material.

With respect to the thermal type inkjet printhead, when a pulse type current flows through a heater formed, e.g., of a resistive heating element, the heat generated in the heater heats the ink adjacent to the heater almost instantly to about 300° C. As a result, the ink starts to boil, resulting the formation of ink bubbles that expand to apply a pressure to the ink filled in an ink chamber. The pressure causes the ink adjacent a nozzle to discharge from the ink chamber through the nozzle in the form of droplets. In a thermal inkjet printhead, it is generally understood that the nozzles have to be uniformly formed in order to achieve print quality.

SUMMARY OF DISCLOSURE

According to an aspect of the present disclosure, there is provided an inkjet printhead that may include: a substrate having an ink feed hole; a chamber layer formed above the substrate, the chamber layer defining a plurality of ink chambers; a nozzle layer formed above the chamber layer, the nozzle layer having formed therein a plurality of nozzles; and a glue layer interposed between the substrate and the chamber layer, the glue layer containing a crosslink inhibitor.

The glue layer may comprise a first negative type photosensitive resin soluble in a first type developing agent. The chamber layer may comprise a second negative type photosensitive resin that is not soluble in the first type developing agent.

For example, the first negative type photosensitive resin may be a solvent soluble resin while the second negative type photosensitive resin may be an alkali soluble resin.

Alternatively, the first negative type photosensitive resin may be an alkali soluble resin while the second negative type photosensitive resin may be a solvent soluble resin.

The crosslink inhibitor may inhibit cross linkage of the first negative type photosensitive resin during an exposing process.

The crosslink inhibitor may comprise a light absorbing dye.

The glue layer may comprise a photosensitive resin and photoacid generator (PGA) that promotes cross linkage of the photosensitive resin. The light absorbing dye may absorb light having the same wavelength as the light absorbance wavelength of the PGA to thereby inhibit cross linkage of the photosensitive resin.

The light absorbing dye may comprise at least one material selected from the group consisting of benzophenone compounds, salicylic acid compounds, phenylacrylate compounds, benzotriazole compounds, coumarin compounds and thioxanthone compounds.

The amount of the light absorbing dye may be about 0.03-5 parts by weight based on 100 parts by weight of the photosensitive resin included in the glue layer.

The inkjet printhead may further comprise an insulating layer formed on the substrate; a plurality of heaters and electrodes sequentially formed on the insulating layer; and a passivation layer covering the heaters and the electrodes.

According to another aspect, A method of manufacturing an inkjet printhead may include forming an ink feed hole in a substrate; providing a glue material layer containing a crosslink inhibitor above the substrate, and exposing the glue material layer; forming one or more ink chambers by providing a chamber material layer above the glue material layer, and by exposing and developing the chamber material layer; providing a nozzle material layer on the chamber layer, and exposing the nozzle material layer; and developing the nozzle material layer and the glue material layer.

The chamber material layer may be developed using a first type developing agent. The glue material layer may not be soluble in the first type developing agent.

The crosslink inhibitor may inhibit cross linkage of the photosensitive resin included in the glue material layer during the exposing process.

The crosslink inhibitor may comprises a light absorbing dye.

The glue layer may comprise a photosensitive resin and photoacid generator (PGA) that promotes cross linkage of the photosensitive resin. The light absorbing dye may absorb light having the same wavelength as the light absorbance wavelength of the PGA to thereby inhibit cross linkage of the photosensitive resin.

The light absorbing dye may comprise at least one material selected from the group consisting of benzophenone compounds, salicylic acid compounds, phenylacrylate compounds, benzotriazole compounds, coumarin compounds and thioxanthone compounds.

The amount of the light absorbing dye may be about 0.03-5 parts by weight based on 100 parts by weight of the photosensitive resin included in the glue material layer.

At least one of the glue material layer, the chamber material layer and the nozzle material layer may be formed of a photosensitive dry film.

The method may further include forming an insulating layer on the substrate; sequentially forming a plurality of heaters and electrodes on the insulating layer; and forming a passivation layer covering the heaters and the electrodes.

The step of forming the ink feed hole may be performed prior to the step of providing the glue material layer. The step of forming the ink feed hole may comprises removing a portion of the substrate staring from the top surface of the substrate continuing to the bottom surface of the substrate so as to create a hole that penetrates through the substrate.

The step of forming the ink feed hole may be performed after to the step of developing the nozzle material layer and the glue material layer. The step of forming the ink feed hole may comprise removing a portion of the substrate staring from the bottom surface of the substrate continuing to the top surface of the substrate so as to create a hole that penetrates through the substrate.

According to yet another aspect, a method of fabricating an inkjet printhead may include forming an anti-diffusion reflection layer above a substrate, the anti-diffusion reflection layer having substantially planar surface, and containing a quantity of crosslink inhibitor; and exposing a nozzle material layer provided above the anti-diffusion reflection layer with light to form a pattern of nozzles on the nozzle material layer.

The method may further include forming one or more ink chambers between the nozzle material layer and the anti-diffusion reflection layer by patterning a chamber material layer placed between the nozzle material layer and the anti-diffusion reflection layer. The chamber material layer may be developed using a first type developing agent. The anti-diffusion reflection layer may not be soluble in the first type developing agent.

The anti-diffusion reflection layer may comprise a first negative type photosensitive resin. The chamber material layer may comprise a second negative type photosensitive resin. The first negative type photosensitive resin may be one of a solvent soluble resin and an alkali soluble resin while the second negative type photosensitive resin may be the other one of the solvent soluble resin and the alkali soluble resin.

The crosslink inhibitor may be a light absorbing dye that may comprises at least one material selected from the group consisting of benzophenone compounds, salicylic acid compounds, phenylacrylate compounds, benzotriazole compounds, coumarin compounds and thioxanthone compounds.

BRIEF DESCRIPTION OF THE DRAWINGS

Various aspects and/or advantages of the embodiments of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
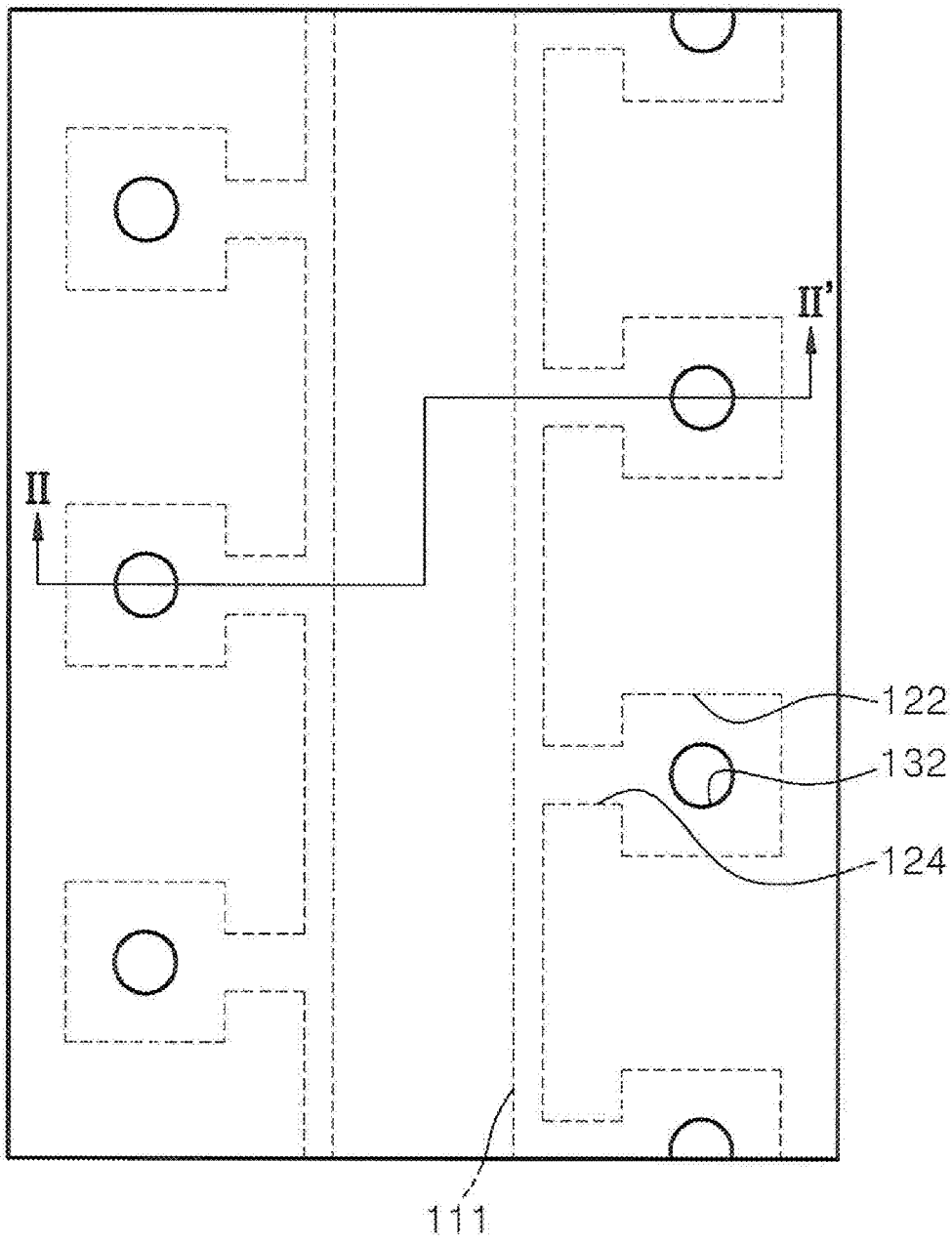
FIG. 1 is a plan view schematically illustrating an inkjet printhead according to an embodiment of the present disclosure.

Several embodiments will now be described more fully with reference to the accompanying drawings. In the drawings, like reference numerals denote like elements, and the sizes and thicknesses of layers and regions may be exaggerated for clarity. While the various embodiments are described for the purpose of providing a thorough and complete disclosure, can have many different forms, the scope of the disclosure should not be construed as being limited to the embodiments specifically set forth herein. It will also be understood that when a layer is referred to as being "on" another layer or substrate, the layer can be disposed directly on the other layer or substrate, or there could be intervening layers between the layer and the other layers or substrate.

Figure 2:
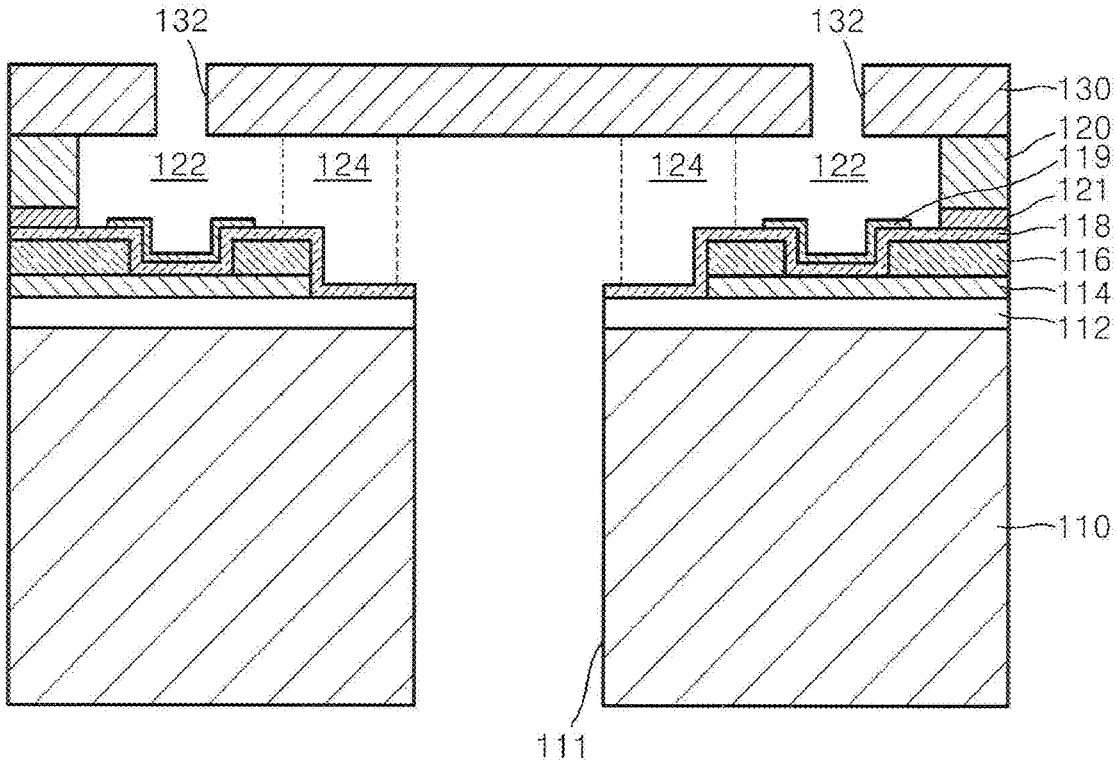
FIG. 2 is a cross-sectional view taken along the line II-II' of FIG. 1.

FIG. 1 is a plan view schematically illustrating an inkjet printhead according to an embodiment. FIG. 2 is a cross-sectional view taken along the line II-II' of FIG. 1.

Referring to FIGS. 1 and 2, a glue layer 121, a chamber layer 120, and a nozzle layer 130 may be formed on a substrate 110 on which a plurality of material layers are formed The substrate 110 may be formed of, for example, silicon, but the material for the substrate is not so limited, and materials other than silicon could also be used. The substrate 110 may include an ink feed hole 111 penetrating therethrough. A plurality of ink chambers 122 may be formed in the chamber layer 120. A plurality of nozzles 132 may be formed in the nozzle layer 130.

An insulating layer 112 may be provided between the substrate 110 and heaters 114, which will be described in greater detail later. The insulating layer 112 may be formed of an insulating material, for example, a silicon oxide, or the like. A plurality of heaters 112 for heating the ink in the ink chambers 122 to generate the ink bubbles may be formed on the insulating layer 112. The heaters 114 may be formed of a heating resistor, for example, a tantalum-aluminum alloy, a tantalum nitride, a titanium nitride, tungsten silicide, or the like. However, it should be readily understood that the material for forming the heaters is not limited to those above specific examples. A plurality of electrodes 116 may be formed on the upper surface of the heaters 114. The electrodes 116 are used to apply the current to the heaters 114, and may be formed of any electrically conductive material, including, for example, aluminum (Al), an aluminum alloy, gold (Au), silver (Ag), or the like. A passivation layer 118 may be formed on the upper surfaces of the heaters 114 and the electrodes 116. The passivation layer 118 prevents the heaters 114 and the electrodes 116 from oxidizing or corroding due to contact with ink, and may be formed of, for example, a silicon nitride, a silicon oxide, or the like. An anti-cavitation layer 119 may be formed on the upper surface of the passivation layer 118, which is disposed on the heaters 1 14. The anti-cavitation layer 119 protects the heaters 114 from a cavitation force generated when the bubbles burst, and may be formed of, for example, tantalum (Ta), or the like.

A glue layer 121 is formed on the passivation layer 118 in order to increase an adhesive strength between the chamber layer 120 and the substrate 110. The thickness of the glue layer 121 may be about 0.5-10 μm, and, preferably, 2-5 μm, for example. However, it should be noted that the above glue layer thicknesses are merely examples, and should not be construed to limiting the thickness to those specific examples. The glue layer 121 may include a photosensitive resin, for example, a negative type photosensitive resin. The photosensitive resin included in the glue layer 121 and the photosensitive resin included in the chamber layer 120, which will be described in greater detail later, may be developed using different developing solutions. For example, the photosensitive resin included in the glue layer 121 may be a solvent soluble resin while the photosensitive resin included in the chamber layer 120 may be an alkali soluble resin. In the alternative, the photosensitive resin included in the glue layer 121 may be an alkali soluble resin while the photosensitive resin included in the chamber layer 120 may be a solvent soluble resin. This will be described in more detail later with reference to the embodiments of the methods of manufacturing the inkjet printhead.

The glue layer 121 may further include a crosslink inhibitor. The crosslink inhibitor may inhibit cross linkage of the photosensitive resin included in the glue layer 121 during an exposing process. More specifically, the crosslink inhibitor may inhibit cross linkage of the photosensitive resin included in a glue material layer 121' (shown in FIG. 9) during the exposure of the nozzle material layer 130' (see FIG. 9). That is, when exposing the nozzle material layer 130', cross linkage of the photosensitive resin may take place in portions of the exposed nozzle material layer 130', but substantially no cross linkage of the photosensitive resin occurs in the glue material layer 121'. This will be described in more detail later with reference to embodiments of the methods of manufacturing the inkjet printhead. The crosslink inhibitor may be, for example, a light absorbing dye. The light absorbing dye absorbs light having the same wavelength as the light absorbance wavelength of a photoacid generator (PGA), which generates the cross linkage of the photosensitive resin during the exposing process, and thus may inhibit cross linkage of the photosensitive resin. Examples of the light absorbing dye may include at least one material selected from the group consisting of benzophenone compounds, salicylic acid compounds, phenylacrylate compounds, benzotriazole compounds, coumarin compounds, and thioxanthone compounds. However, the material for forming the light absorbing dye is not limited to the above specific examples. An amount of the light absorbing dye included in the glue layer 121 may be about 0.03-5 parts by weight based on 100 parts by weight of the photosensitive resin included in the glue layer 121. The light absorbing dye described above is only an example of the crosslink inhibitor, and the same should not be construed as a limitation.

The chamber layer 120 is formed on the glue layer 121. The ink chambers 122, in which ink supplied through the ink feed hole 111 may be filled, are formed on the chamber layer 120. A plurality of restrictors 124, which act as the paths from the ink feed hole 111 to the ink chambers 122, may further be formed in the chamber layer 120. The chamber layer 120 may include a negative type photosensitive resin. As described above, the photosensitive resin included in the glue layer 121 and the photosensitive resin included in the chamber layer 120 may be developed using different developing solutions. The nozzle layer 130 is formed above the chamber layer 120. The nozzles 132 through which ink is discharged may be formed on the nozzle layer 130. The nozzle layer 130 may include a negative type photosensitive resin.

According to embodiments of the present disclosure, the glue layer 121 including the crosslink inhibitor may be formed between the substrate 110 and the chamber layer 120 so that a diffused reflection, which may be caused by exposing the nozzle material layer 130' (shown in FIG. 9), may be prevented, and thereby, the nozzles 132 may be uniformly formed as desired.

Hereinafter, a method according to several embodiments of manufacturing the inkjet printhead described above will be described with reference to FIGS. 3 through 10.

Figure 3:
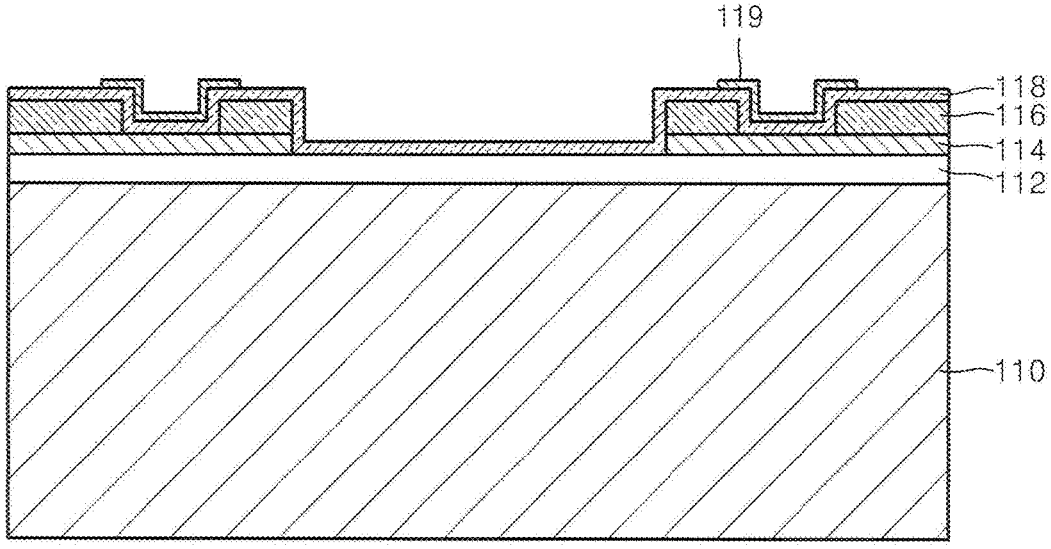
FIGS. 3 through 10 are cross-sectional views for illustrating a method of manufacturing an inkjet printhead according to an embodiment of the present disclosure.

Referring to FIG. 3, the substrate 110 is prepared and the insulating layer 112 may be formed on the upper surface of the substrate 110. The substrate 110 may, e.g., be a silicon substrate. The insulating layer 112 insulates the substrate 110 and the heaters from each other, and may be formed of, for example, silicon oxide. Then, the heaters 114 for heating the ink and for generating the ink bubbles may be formed on the upper surface of the insulating layer 112. The heaters 114 may be formed by depositing a layer of heating resistor composed of; for example, a tantalum-aluminum alloy, a tantalum nitride, a titanium nitride, tungsten silicide, or the like, on the upper surface of the insulating layer 112, and by patterning the deposited heating resistor layer. Then, the electrodes 116 for applying the current to the heaters 114 may be formed on the upper surface of the heaters 114. The electrodes 116 may be formed, e.g., by depositing a layer metal having sufficient electrical conductivity, for example, aluminum (Al), an aluminum alloy, gold (Au), silver (Ag), or the like, on the upper surfaces of the heaters 114, and then by patterning the deposited metal layer.

The passivation layer 118 may be formed on the insulating layer 112 to cover the heaters 114 and the electrodes 116. The passivation layer 118 prevents the heaters 114 and the electrodes 116 from oxidizing or corroding due to contact with ink, and may be formed of, for example, a silicon nitride, a silicon oxide, or the like. The anti-cavitation layer 119 may additionally be formed on the upper surface of the passivation layer 118, which is disposed on the heaters 114. The anti-cavitation layer 119 protects the heaters 114 from a cavitation force generated bubbles burst, and may be formed of, for example, tantalum (Ta), or the like.

Figure 4:
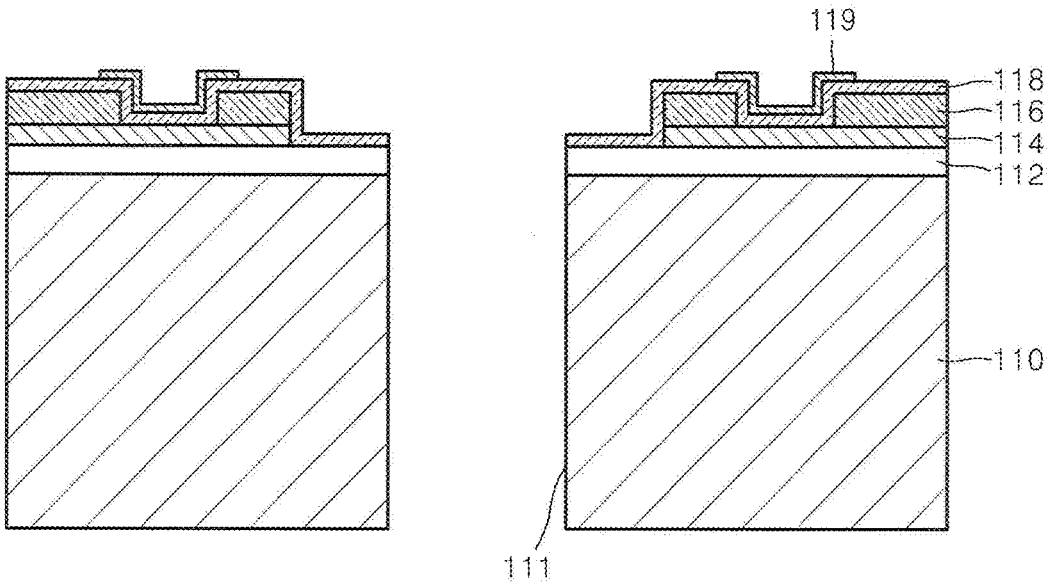

Referring to FIG. 4, the ink feed hole 111 may be formed in the substrate 110 by, e.g., sequentially processing the passivation layer 118, the insulating layer 112, and the substrate 110. The ink feed hole 111 may be formed by using, for example, dry etching, wet etching, or laser processing. The ink feed hole 111 may be formed to penetrate the substrate 110 from the upper surface thereof to the lower surface thereof. An advantage of processing from the upper portion of the substrate 110 to form the ink feed hole 111 may be that the properly forming the upper portion of the ink feed hole 111 at the desired location may become relatively easier. However, according to alternative embodiments of the present disclosure, the ink feed hole 111 may be formed by processing from the bottom of the substrate 110.

Figure 5:
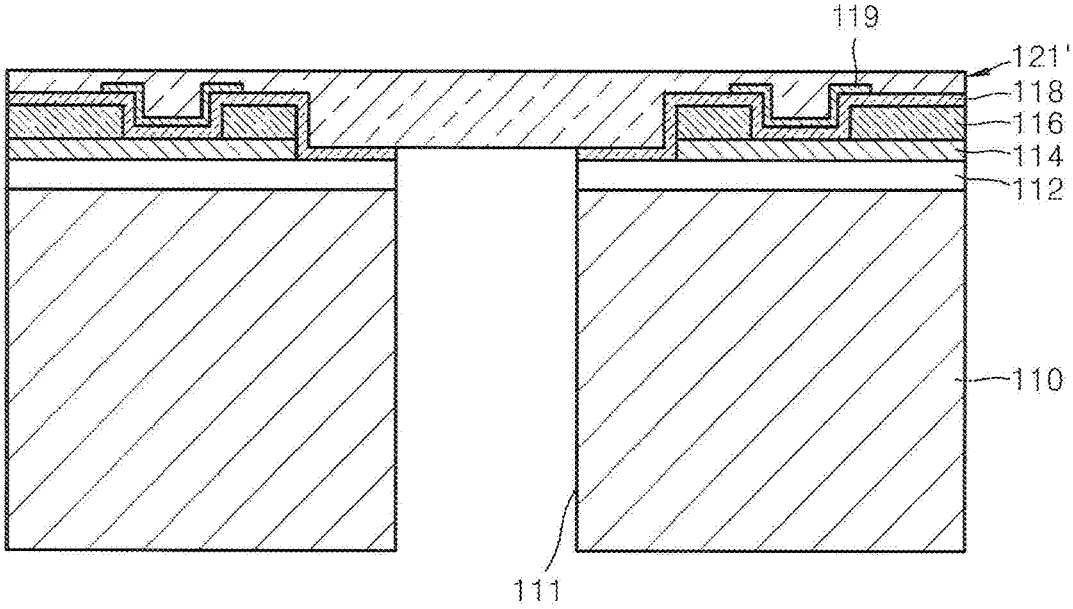

A glue material layer 121' may be formed above the passivation layer 118 as shown in FIG. 5. The thickness of the glue material layer 121' may be about 0.5-10 μm, or more preferably 2-5 μm, for example. The thickness of the glue material layer 121' however is not limited to the above specific examples. According to an embodiment, the glue material layer 121' may include a negative type photosensitive resin, a photoacid generator (PAG) and a crosslink inhibitor. The glue material layer 121' may be formed by laminating a photosensitive dry film including the negative type photosensitive resin, the PAG and the crosslink inhibitor on the passivation layer 118.

The PAG absorbs light having a predetermined wavelength during the exposing of the glue material layer 121', and generates $H^+$, thereby generating cross linkage of the photosensitive resin. The crosslink inhibitor inhibits cross linkage of the photosensitive resin included in the glue material layer 121' up to certain amount of light exposure during the exposing of the glue material layer 121', but when the amount of light exposure exceeds the threshold amount, the crosslink inhibitor loses its effectiveness, and thus allows the cross linkage of the photosensitive resin by the PAG to occur.

An example of the crosslink inhibitor may be, for example, a light absorbing dye. The light absorbing dye absorbs light having the same wavelength as the light absorbance wavelength of the PAG, and thus inhibits PAG from absorbing light. Accordingly, cross linkage of the photosensitive resin may be inhibited in parts of the exposed glue material layer 121'. Examples of the light absorbing dye may include at least one material selected from the group consisting of benzophenone compounds, salicylic acid compounds, phenylacrylate compounds, benzotriazole compounds, coumarin compounds, and thioxanthone compounds. However, the material for forming the light absorbing dye is not limited to those above. According to an embodiment, the amount of the light absorbing dye included in the glue material layer 121' may be about 0.03-5 parts by weight based on 100 parts by weight of the photosensitive resin included in the glue material layer 121'. For example, the glue material layer 121' may be formed of 100 parts by weight of the negative type photosensitive resin, 4 parts by weight of the PAG, and 2 parts by weight of the light absorbing dye.

In addition or alternative to the light absorbing dye used as the crosslink inhibitor, various other materials may also be used as the crosslink inhibitor. For example, a predetermined base material may be used as the crosslink inhibitor. A base ($OH^-$) included in the base material is combined to $H^+$ generated from the PAG, within a range of a predetermined light exposure amount during the exposing and thus can inhibit cross linkage of the photosensitive resin.

According to an embodiment, the photosensitive resin included in the glue material layer 121' and a photosensitive resin included in a chamber material layer, which will be described later, may each be developed using different developing solutions. More specifically, the negative type photosensitive resin included in a non-exposed part of the glue material layer 121' and the negative type photosensitive resin included in a non-exposed part of the chamber material layer may be developed using different developing solutions. For example, the photosensitive resin included in the glue material layer 121' may be a solvent soluble resin while the photosensitive resin included in the chamber material layer may be an alkali soluble resin. Examples of the solvent soluble resin may include Su-8 manufactured by Micro Chem of Newton, Mass., U.S.A. Examples of the alkali soluble resin may include ANR manufactured by AZ Electronic Materials Corp. of Charlotte, N.C., U.S.A., SPS manufactured by Shin-Etsu Chemical Co., Ltd. of Tokyo, Japan, and WPR manufactured by JSR Corporation of Tokyo, Japan. However, the solvent soluble resin and the alkali soluble resin of the present embodiment are not limited the above examples.

When the negative type photosensitive resin included in the glue material layer 121' is the solvent soluble resin, a developing solution used to develop a non-exposed part 121*b* of the glue material layer 121' may include, for example, propylene glycol monomethyl ether acetate (PGMEA), gamma-butyrolactone (GBL), cyclopentanon (CP), or methyl isobutyl ketone (MIBK). When the negative type photosensitive resin included in the chamber material layer is the alkali soluble resin, a developing solution used to develop a non-exposed part of the chamber material layer may include, for example, 300 MIF, 400K, or CD30 manufactured by AZ Electronic Materials Corp. However, the developing solutions are not limited thereto. According to an alternative embodiment, the photosensitive resin included in the glue material layer 121' may be the alkali soluble resin while the photosensitive resin included in the chamber material layer may be the solvent soluble resin.

Figure 6:
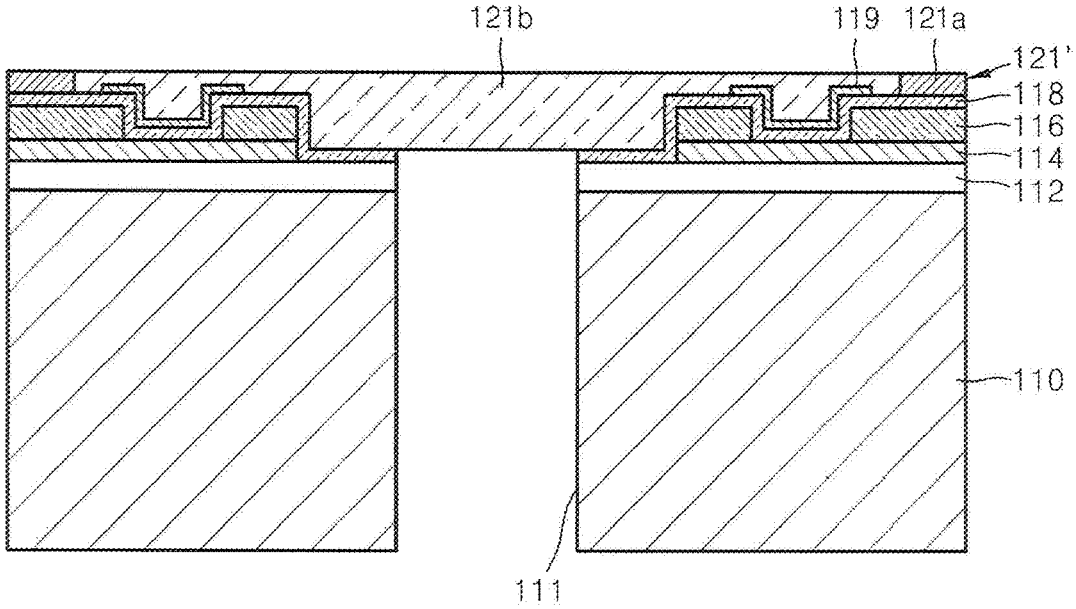

Referring to FIG. 6, an exposing process is performed on the glue material layer 121'. The exposing process may be performed after preparing a photomask (not shown), on which a predetermined pattern (for example, the pattern that is the same as the ink chamber pattern) is formed, on the upper portion of the glue material layer 121' and may involve subsequent irradiating ultraviolet (UV) rays having a predetermined wavelength on the photomask. UV rays in a light exposure amount that is greater than an amount at which the crosslink inhibitor may be effective are irradiated onto the glue material layer 121 ' during the exposing of the glue material layer 121'. Accordingly, cross linkage of the photosensitive resin is generated in an exposed part 121*a* of the glue material layer 121'.

The reference numeral 121*b* in FIG. 6 denotes a non-exposed part of the glue material layer 121'.

Figure 7:
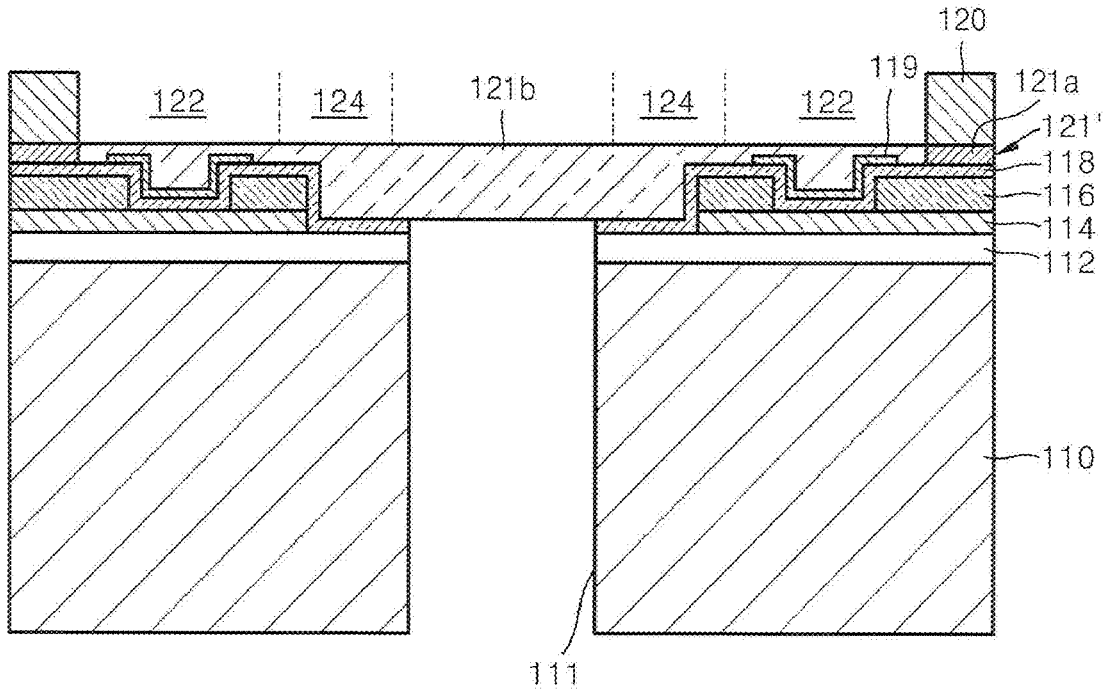

Referring to FIG. 7, the chamber layer 120 is formed on the glue material layer 121'. The chamber layer 120 is formed after forming a chamber material layer (not shown) on the glue material layer 121' and then, exposing and developing the chamber material layer. The chamber material layer may be formed by, for example, laminating a photosensitive dry film including the negative type photosensitive resin and the PAG on the glue material layer 121'. The exposing process for the chamber material layer may be performed after preparing a photomask (not shown), on which a predetermined ink chamber pattern is formed, on the upper portion of the chamber material layer., and may involve the irradiating UV having a predetermined wavelength on the photomask. According to the exposing process for the chamber material layer, cross linkage of the photosensitive resin is generated in the exposed part of the chamber material layer. As previously described, the photosensitive resin included in the chamber material layer and the photosensitive resin included in the glue material layer 121' may each be developed with different developing solution. For example, the photosensitive resin included in the glue material layer 121' may be a solvent soluble resin while the photosensitive resin included in the chamber material layer may be an alkali soluble resin. In that case, the developing solution for developing a non-exposed part of the chamber material layer may be, for example, 300 MIF, 400K, or CD30 available from AZ Electronic Materials Corp. When the chamber material layer is developed by using a developing solution, as no cross linkage occurs in the non-exposed portion, the non-exposed portion of the chamber material layer is removed, thus forming the chamber layer 120 having the ink chambers 122. A plurality of restrictors connecting the ink chambers 122 and the ink feed hole 111 may further be formed in the chamber layer 120.

In the previous descriptions, the respective exposing processes for the glue material layer 121' and for the chamber material layer were performed sequentially. However, according to an embodiment, the exposing process for the glue material layer 121' and the exposing process for the chamber material layer may be performed simultaneously. That is, the glue material layer 121' and the chamber material layer are sequentially formed on the passivation layer 118 and then, the exposing process for the glue material layer 121' and the chamber material layer may be simultaneously performed by using a photomask (not shown) on which the ink chamber pattern is formed.

Figure 8:
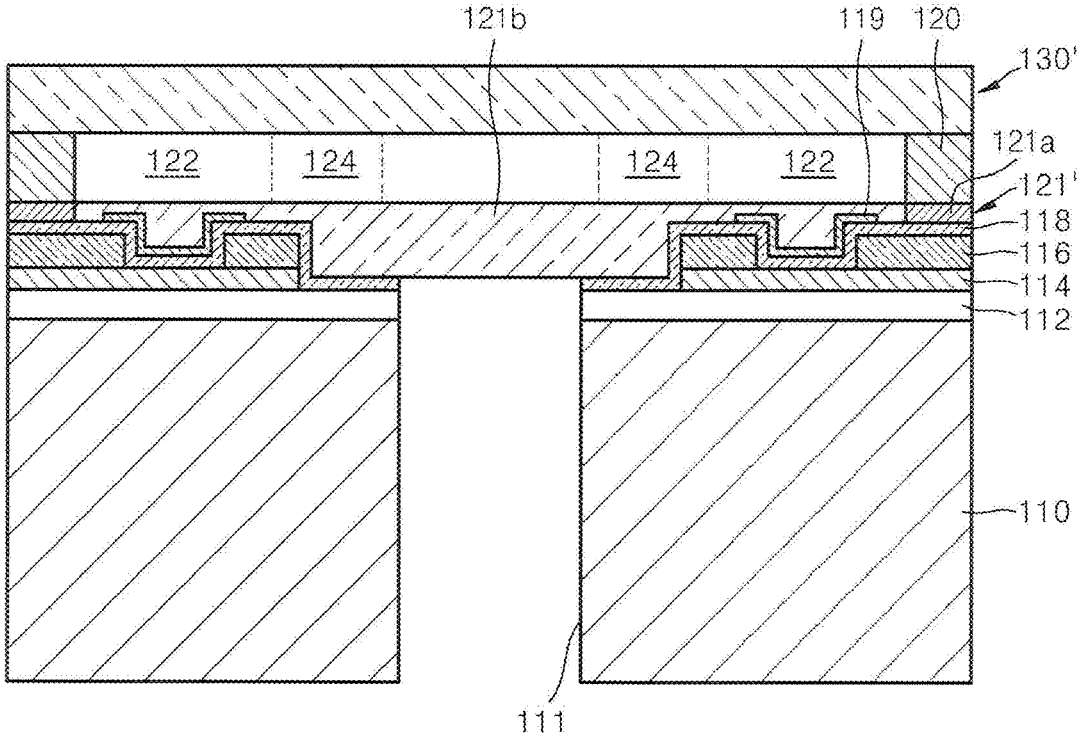

Referring to FIG. 8, the nozzle material layer 130' may be formed on the chamber layer 120. The nozzle material layer 130' may include a negative type photosensitive resin and the PAG. The photosensitive resin included in the nozzle material layer 130' may be the same as the photosensitive resin included in the glue material layer 121', for example. The nozzle material layer 130' may be formed by laminating a photosensitive dry film including the negative type photosensitive resin and the PAG on the chamber layer 120.

Figure 9:
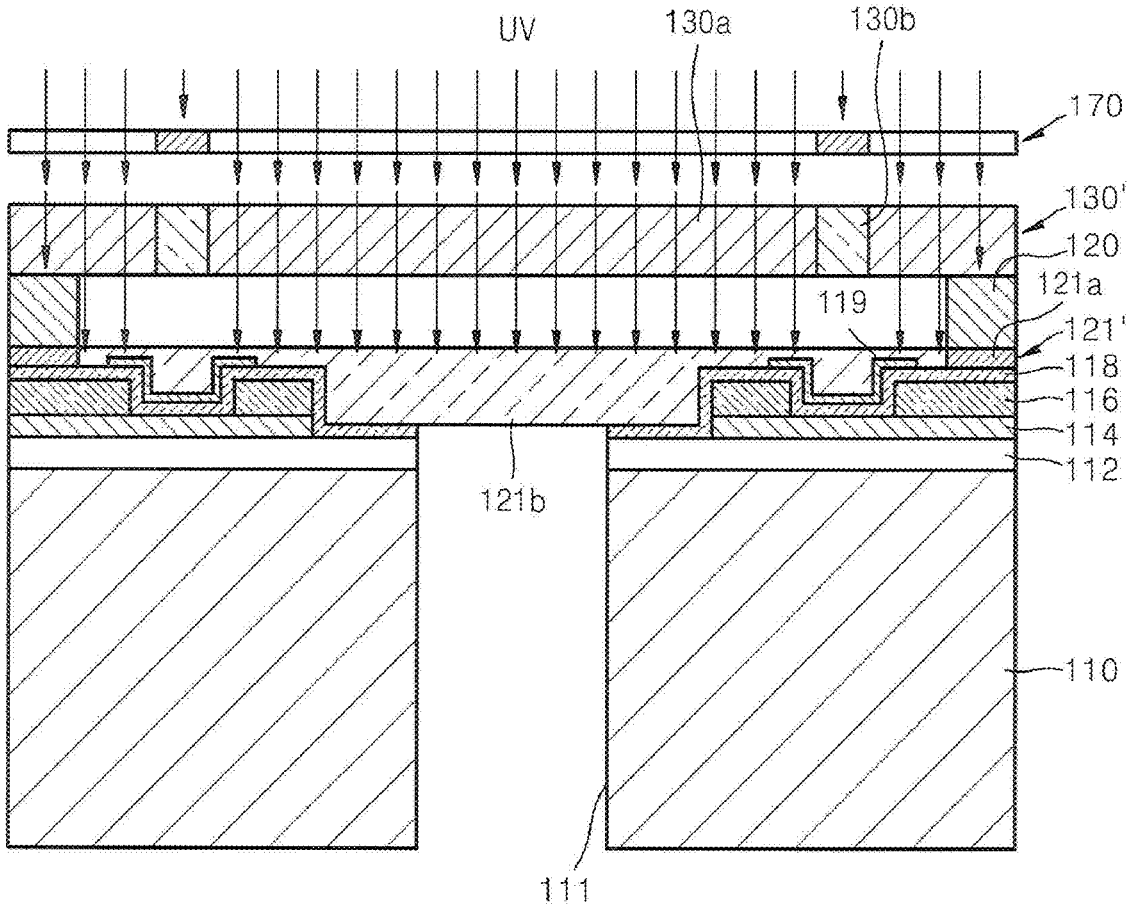

Referring to FIG. 9, an exposing process is performed on the nozzle material layer 130'. The exposing process for the nozzle material layer 130' may be performed by preparing a photomask 170, on which a nozzle pattern is formed, above the nozzle material layer 130', and by irradiating UV rays having a predetermined wavelength on the photomask 170. As a result of the exposing process, cross linkage of the photosensitive resin is generated in the exposed portion 130*a* of the nozzle material layer 130'. The reference numeral 130*b* in FIG. 9 denotes the non-exposed portion of the nozzle material layer 130'. During the exposing process for the nozzle material layer 130', UV rays that penetrate through the nozzle material layer 130' are blocked by the glue material layer 121' formed on the passivation layer 118. Therefore, a diffused reflection may be prevented to allow the nozzles 132 (see FIG. 10) to be uniformly formed in the desired form. In the exposing process for the nozzle material layer 130', cross linkage is not generated in the glue material layer 121' due to the crosslink inhibitor included in the glue material layer 121'.

Figure 11:
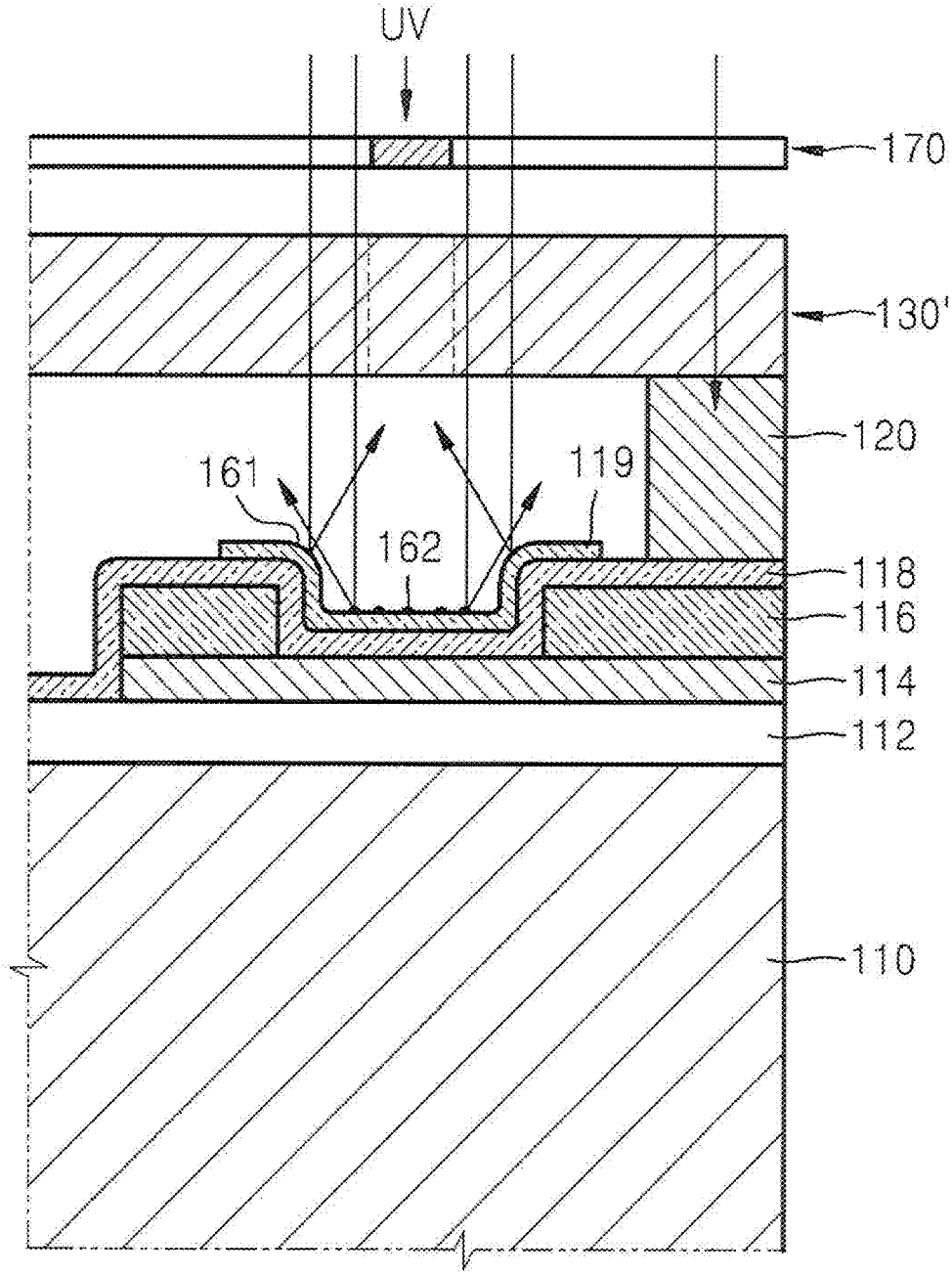
FIG. 11 illustrates a nozzle material layer that is exposed when a glue material layer including a crosslink inhibitor is not formed on a passivation layer.

For better understanding, the situation in which the nozzle material layer 130' is exposed when the glue material layer 121' including the crosslink inhibitor is absent will be described with reference to FIG. 11. Referring to FIG. 11, in exposing the nozzle material layer 130', UV rays that penetrate through the nozzle material layer 130' may be diffusedly reflected off the anti-cavitation layer 119. In typical manufacturing of an inkjet printhead, when the electrode material formed on the heaters 114 is patterned, a stepped structure typically results in the electrodes 116. For example, referring to FIG. 11, a stepped portion 162 may be formed on the anti-cavitation layer 119 in an area corresponding to the stepped structure of the electrodes 116. The electrode material may be formed by adding impurities, such as, for example, silicon and/or copper to, for example, aluminum. When the electrode material is patterned so as to form the electrodes 116, aluminum may be removed by wet etching, which may result in the impurities such as silicon or copper remaining on the heaters 114. When the passivation layer 118 and the anti-cavitation layer 119 are sequentially formed on the heaters 114, the protrusion portions 161 corresponding to the impurities remaining on the heaters may be formed on the anti-cavitation layer 119. As such, when the protrusion portions 161 and/or the stepped portion 162 is formed on the anti-cavitation layer 119, the UV rays that has penetrated the nozzle material layer 130' during the exposing process for the nozzle material layer 130' may cause a diffused reflection on the stepped portion 162 or the protrusion portions 161. Due to the diffusedly reflected UV rays, unintended portions of the nozzle material layer 130' may also be exposed, which may adversely impact the uniformity of the formation of the nozzles 132.

According to embodiments of the present disclosure, when the glue material layer 121' containing the crosslink inhibitor is formed on the passivation layer 118, UV rays penetrating through the nozzle material layer 130' during the exposing of the nozzle material layer 130' may be blocked by the glue material layer 121'. Accordingly, an improvement in the uniformity of the nozzles 132 may be achieved.

Figure 10:
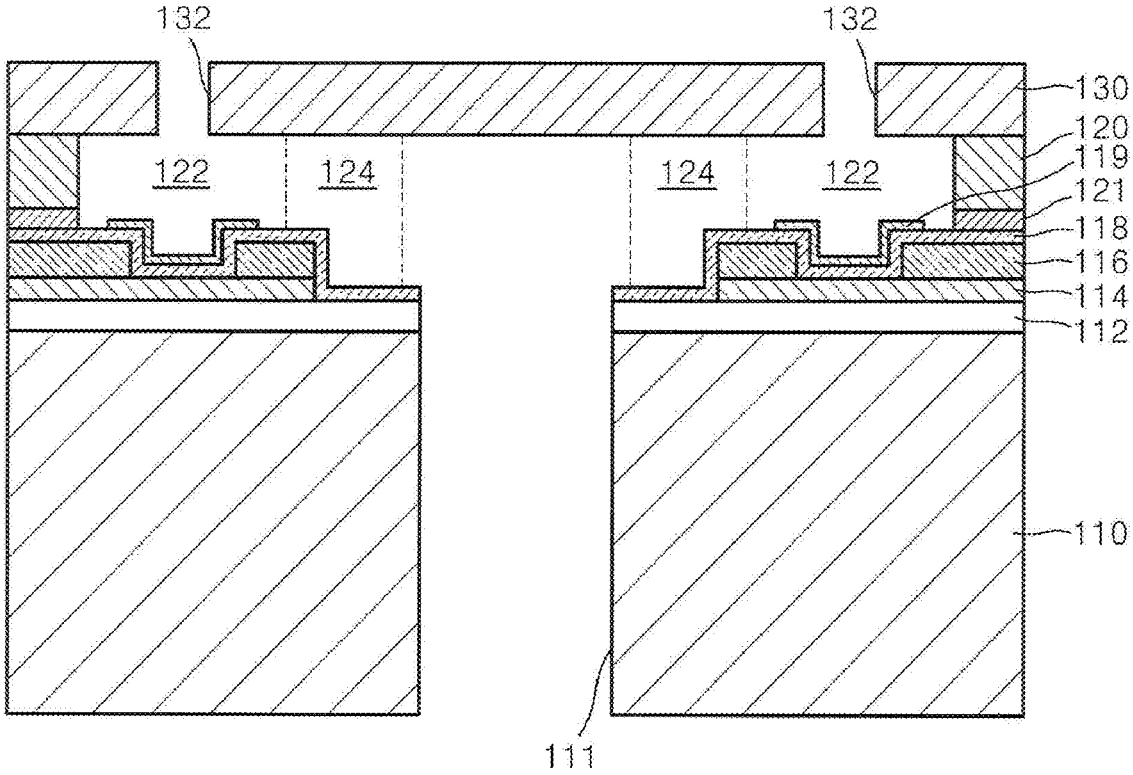

Referring again to FIG. 10, when the nozzle material layer 130' and the glue material layer 121' are developed with a developing agent, the fabrication of an inkjet printhead is completed. The developing of the nozzle material layer 130' and the developing of the glue material layer 121' may be sequentially or simultaneously performed. Due to such developing process, the non-exposed part 130*b* of the nozzle material layer 130' (see FIG. 9) and the non-exposed part 121*b* of the glue material layer 121' (see FIG. 8), where the cross linkage did not occur, are removed. For example, when the photosensitive resin included in the glue material layer 121' and the photosensitive resin included in the nozzle material layer 130' are of a solvent soluble resin material, the developing solution used to develop the non-exposed part 121*b* of the glue material layer 121' and the non-exposed part 130*b* of the nozzle material layer 130' may include, for example, propylene glycol monomethyl ether acetate (PGMEA), gamma-butyrolactone (GBL), cyclopentanon (CP), or methyl isobutyl ketone (MIBK). Accordingly, the nozzle layer 130 having the nozzles 132 is formed on the chamber layer 120 and the glue layer 121 is formed between the passivation layer 118 and the chamber layer 120 as shown in FIG. 10.

FIGS. 12 through 18 are cross-sectional views for illustrating a method of manufacturing an inkjet printhead according to another embodiment of the present disclosure. For the sake of brevity, only those aspects that are substantially different from those of the previously described embodiments will be the primary focus of the following descriptions.

Figure 12:
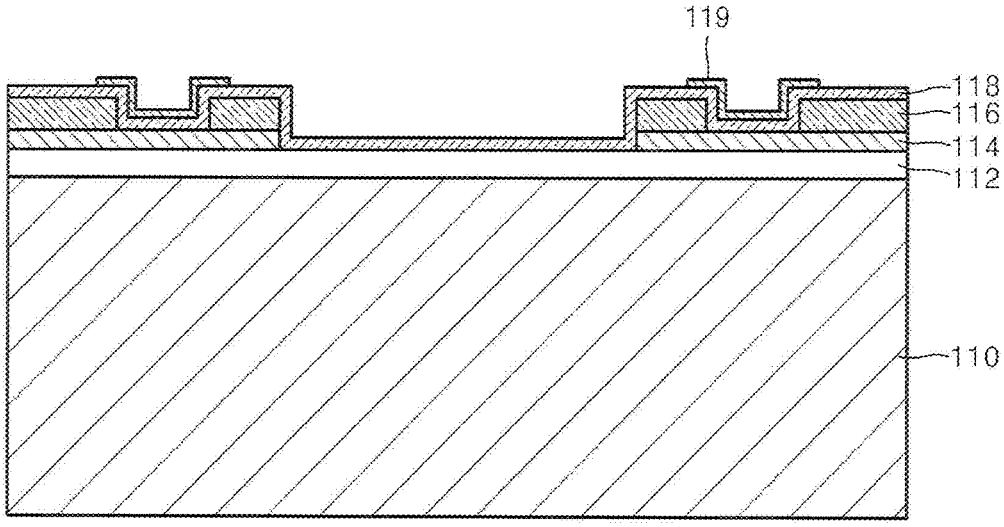
FIGS. 12 through 18 are cross-sectional views for illustrating a method of manufacturing an inkjet printhead according to another embodiment of the present disclosure.
Figure 13:
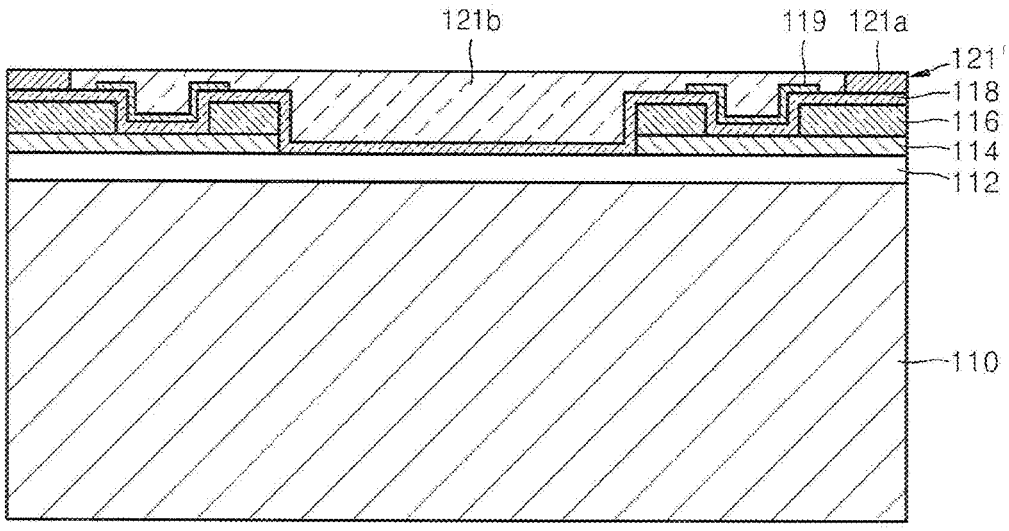

Referring to FIG. 12, the insulating layer 112, the heaters 114, the electrodes 116, the passivation layer 118, and the anti-cavitation layer 119 are formed on the substrate 110. Such processes were previously described, and thus a detailed description is not repeated. Referring to FIG. 13, the glue material layer 121', which may include a negative type photosensitive resin, a PAG and a crosslink inhibitor, formed on the passivation layer 118, is exposed. As previously described, the cross linkage of the photosensitive resin is generated in the exposed part 121*a* of the glue material layer 121' as a result of the exposure. The photosensitive resin included in the glue material layer 121' and a photosensitive resin included in a chamber material layer, may be developed using different developing solutions. The glue material layer 121' may be formed, for example, by coating a liquid-type photosensitive material on the passivation layer 118 or by laminating the photosensitive dry film on the passivation layer 118.

Figure 14:
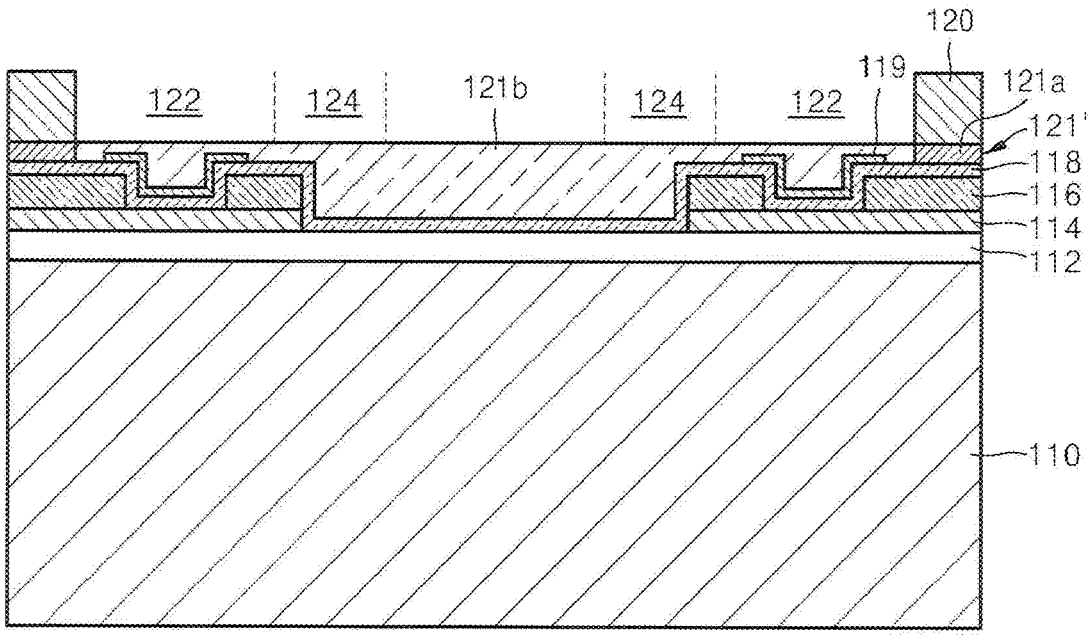

Referring to FIG. 14, the chamber material layer (not shown), which may include a negative type photosensitive resin and PAG may be formed on the glue material layer 121'. Such chamber material layer may be exposed and developed, thereby forming the chamber layer 120. The chamber material layer may be formed, for example, by laminating a photosensitive dry film which may include a negative type photosensitive resin and PAG, on the glue material layer 121'. Again, as described above, the photosensitive resin included in the chamber material layer and the photosensitive resin included in the glue material layer 121 may be developed using different developing solutions. So formed chamber layer 120 may include a plurality of ink chambers 122 and a plurality of restrictors 124. According to an embodiment, both exposing processes for the glue material layer 121' and for the chamber material layer may be performed simultaneously.

Figure 15:
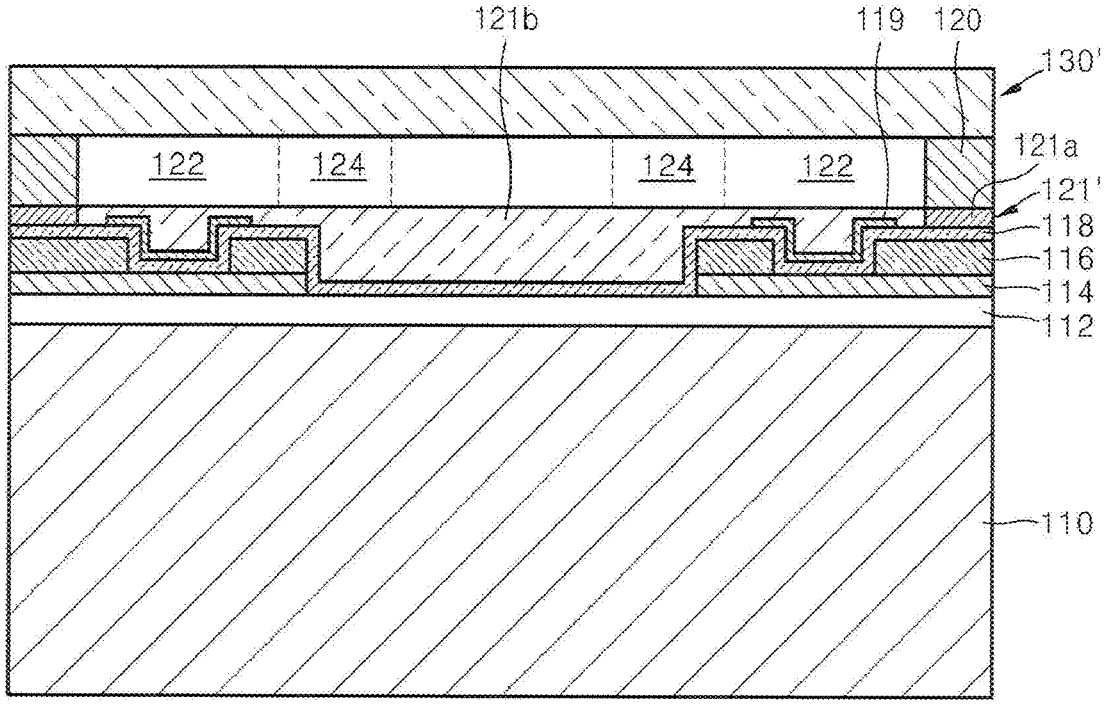
Figure 16:
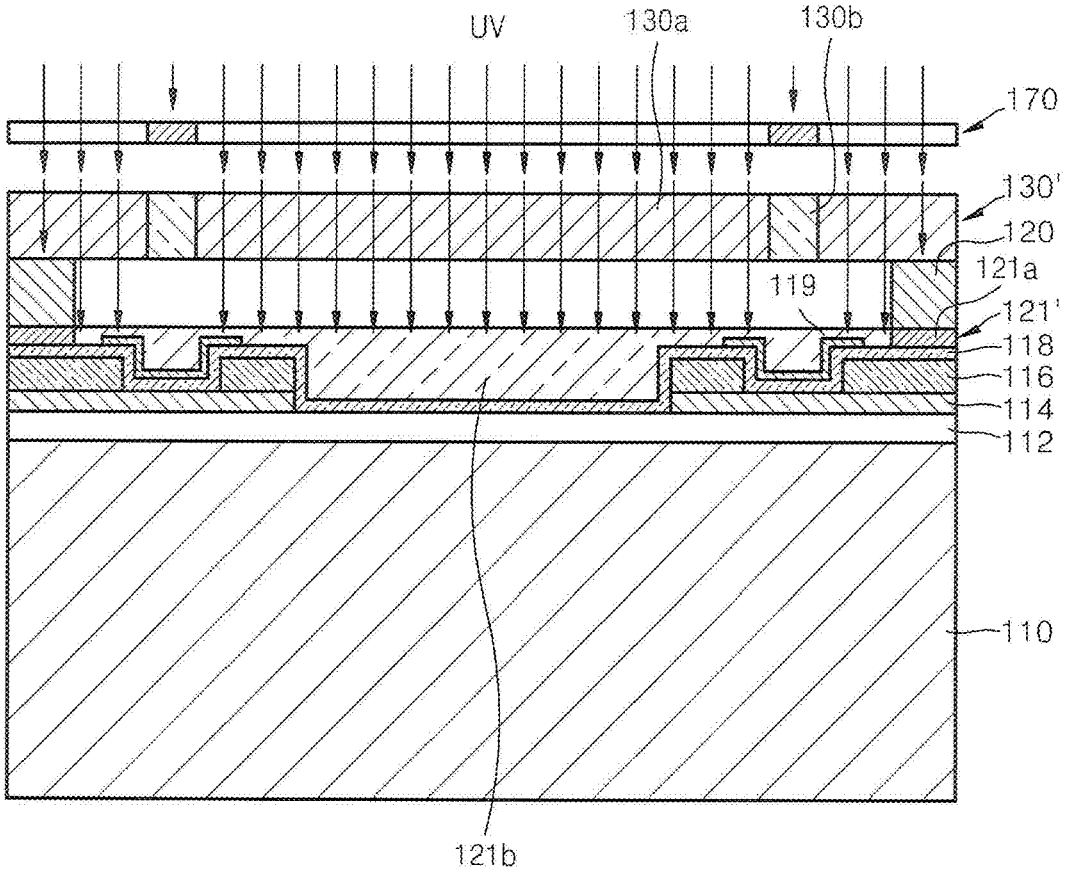

Referring to FIG. 15, the nozzle material layer 130 is formed on the chamber layer 120. The nozzle material layer 130' may be formed, for example, by laminating a photosensitive dry film, which may include a negative type photosensitive resin and PAG, on the chamber layer 120. According to an embodiment, the photosensitive resin included in the nozzle material layer 130' may be the same as the photosensitive resin included in the glue material layer 121'. Referring to FIG. 16, the exposing process for the nozzle material layer 130' is performed. The exposing process for the nozzle material layer 130' may be performed, for example, by preparing the photomask 170, on which a nozzle pattern is formed, above the nozzle material layer 130', and by irradiating UV rays having a predetermined wavelength onto the photomask 170. As a result of such exposing process, cross linkage of the photosensitive resin may be generated in the exposed part 130*a* of the nozzle material layer 130'. As previously described, during the exposing process for the nozzle material layer 130', substantially no cross linkage of the photosensitive resin occurs in the glue material layer 121' due to the crosslink inhibitor included in the glue material layer 121'. Since UV rays penetrating through the nozzle material layer 130' during exposing the nozzle material layer 130' is blocked by the glue material layer 121' formed on the passivation layer 118, diffused reflections of the UV may be prevented, and, as previously described, the nozzles 132 (see FIG. 17) may be formed uniformly in the desired configuration.

Figure 17:
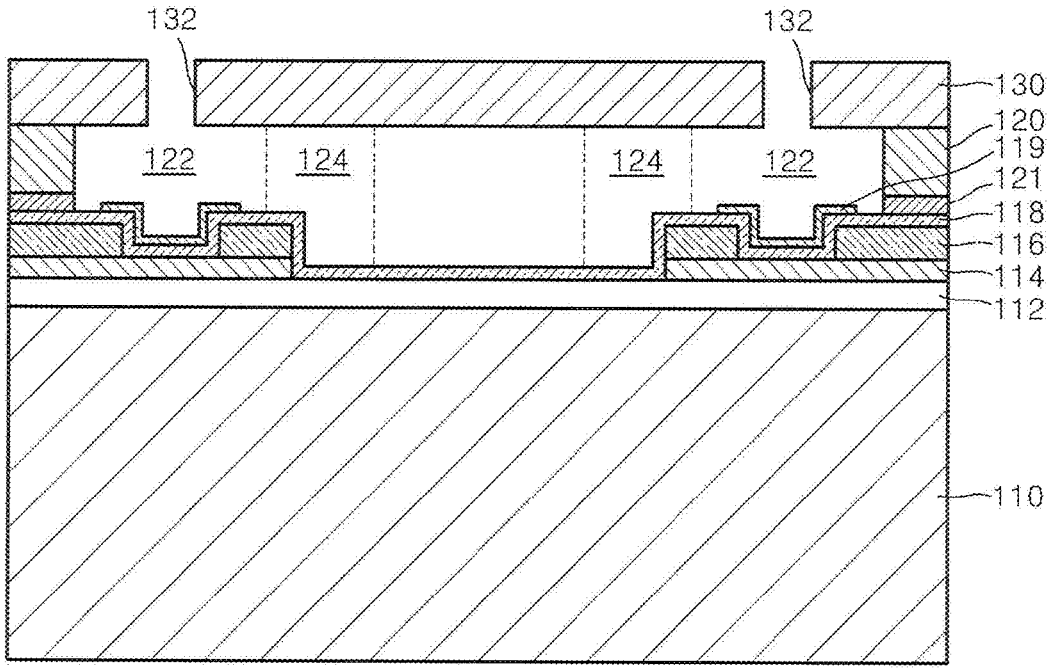
Figure 18:
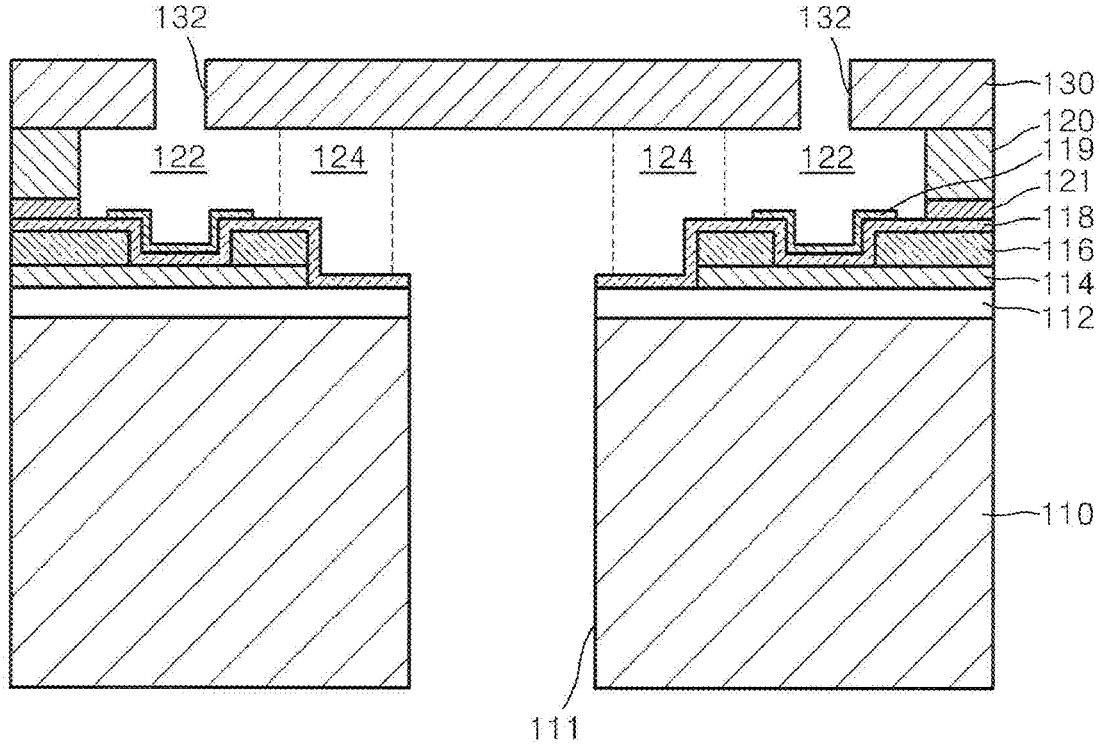

Referring to FIG. 17, the nozzle material layer 130' and the glue material layer 121' may be developed using a developing solution. According to an embodiment, the developing of the nozzle material layer 130' and developing of the glue material layer 121' may be sequentially performed. As a result of such developing process, the non-exposed part 130*b* of the nozzle material layer 130' (see FIG. 16) and the non-exposed part 121*b* of the glue material layer 121' (see FIG. 15), in both of which no cross linkage had occurred, may be removed. Accordingly, the nozzle layer 130 having the nozzles 132 is formed on the chamber layer 120, and the glue layer 121 is formed between the passivation layer 118 and the chamber layer 120 as depicted in FIG. 17. Referring to FIG. 18, when the ink feed hole 111 for supplying ink is formed on the substrate 110, the manufacturing of the inkjet printhead could be considered completed. The ink feed hole 111 may be formed by etching so as to penetrate the substrate 110 from the lower surface thereof to the upper surface thereof.

While the disclosure has been particularly shown and described with reference to several embodiments thereof with particular details, it will be understood by those of ordinary skill in the art that various changes in form and details may be made therein without departing from the spirit and scope of the disclosure as defined by the following claims.

What is claimed is:

1. An inkjet printhead, comprising:

a substrate having an ink feed hole;

a chamber layer formed above the substrate, the chamber layer defining a plurality of ink chambers;

a nozzle layer formed above the chamber layer, the nozzle layer having formed therein a plurality of nozzles; and a glue layer interposed between the substrate and the chamber layer, the glue layer containing a crosslink inhibitor.

2. The inkjet printhead of claim 1, wherein the glue layer comprises a first negative type photosensitive resin soluble in a first type developing agent, the chamber layer comprising a second negative type photosensitive resin that is not soluble in the first type developing agent.

3. The inkjet printhead of claim 2, wherein the first negative type photosensitive resin is a solvent soluble resin, the second negative type photosensitive resin being an alkali soluble resin.

4. The inkjet printhead of claim 2, wherein the first negative type photosensitive resin is an alkali soluble resin, the second negative type photosensitive resin being a solvent soluble resin.

5. The inkjet printhead of claim 2, wherein the crosslink inhibitor inhibits cross linkage of the first negative type photosensitive resin during an exposing process.

6. The inkjet printhead of claim 1, wherein the crosslink inhibitor comprises a light absorbing dye.

7. The inkjet printhead of claim 6, wherein the glue layer comprises a photosensitive resin and photoacid generator (PGA) that promotes cross linkage of the photosensitive resin, the light absorbing dye absorbing light having the same wavelength as the light absorbance wavelength of the PGA to thereby inhibit cross linkage of the photosensitive resin.

8. The inkjet printhead of claim 6, wherein the light absorbing dye comprises at least one material selected from the group consisting of benzophenone compounds, salicylic acid compounds, phenylacrylate compounds, benzotriazole compounds, coumarin compounds and thioxanthone compounds.

9. The inkjet printhead of claim 6, wherein the glue layer comprises a photosensitive resin, and wherein an amount of the light absorbing dye is about 0.03-5 parts by weight based on 100 parts by weight of the photosensitive resin.

10. The inkjet printhead of claim 1, further comprising:

an insulating layer formed on the substrate;

a plurality of heaters and electrodes sequentially formed on the insulating layer; and a passivation layer covering the heaters and the electrodes.

11. A method of manufacturing an inkjet printhead, comprising:

forming an ink feed hole in a substrate;

providing a glue material layer containing a crosslink inhibitor above the substrate, and exposing the glue material layer;

forming one or more ink chambers by providing a chamber material layer above the glue material layer, and by exposing and developing the chamber material layer;

providing a nozzle material layer on the chamber layer, and exposing the nozzle material layer; and developing the nozzle material layer and the glue material layer.

12. The method of claim 11, wherein the chamber material layer is developed using a first type developing agent, the glue material layer not being soluble in the first type developing agent.

13. The method of claim 12, wherein the crosslink inhibitor inhibits cross linkage of a photosensitive resin included in the glue material layer during an exposing process.

14. The method of claim 11, wherein the crosslink inhibitor comprises a light absorbing dye.

15. The method of claim 14, wherein the glue material layer comprises a photosensitive resin and photoacid generator (PGA) that promotes cross linkage of the photosensitive resin, the light absorbing dye absorbing light having the same wavelength as the light absorbance wavelength of the PGA to thereby inhibit cross linkage of the photosensitive resin.

16. The method of claim 14, wherein the light absorbing dye comprises at least one material selected from the group consisting of benzophenone compounds, salicylic acid compounds, phenylacrylate compounds, benzotriazole compounds, coumarin compounds and thioxanthone compounds.

17. The method of claim 14, wherein an amount of the light absorbing dye is about 0.03-5 parts by weight based on 100 parts by weight of a photosensitive resin included in the glue material layer.

18. The method of claim 11, wherein at least one of the glue material layer, the chamber material layer and the nozzle material layer is formed of a photosensitive dry film.

19. The method of claim 11, further comprising:

forming an insulating layer on the substrate;

sequentially forming a plurality of heaters and electrodes on the insulating layer; and forming a passivation layer covering the heaters and the electrodes.

20. The method of claim 11, wherein the step of forming the ink feed hole is performed prior to the step of providing the glue material layer, and wherein the step of forming the ink feed hole comprises removing a portion of the substrate staring from the top surface of the substrate continuing to the bottom surface of the substrate so as to create a hole that penetrates through the substrate.

21. The method of claim 11, wherein the step of forming the ink feed hole is performed after to the step of developing the nozzle material layer and the glue material layer, and wherein the step of forming the ink feed hole comprises removing a portion of the substrate staring from the bottom surface of the substrate continuing to the top surface of the substrate so as to create a hole that penetrates through the substrate.

22. A method of fabricating an inkjet printhead, comprising:

forming an anti-diffusion reflection layer above a substrate, the anti-diffusion reflection layer having substantially planar surface, and containing a quantity of crosslink inhibitor; and exposing a nozzle material layer provided above the anti-diffusion reflection layer with light to form a pattern of nozzles on the nozzle material layer.

23. The method according to claim 22, further comprising:

forming one or more ink chambers between the nozzle material layer and the anti-diffusion reflection layer by patterning a chamber material layer placed between the nozzle material layer and the anti-diffusion reflection layer, the chamber material layer being developed using a first type developing agent, the anti-diffusion reflection layer not being soluble in the first type developing agent.

24. The method according to claim 22, wherein the anti-diffusion reflection layer comprises a first negative type photosensitive resin, the chamber material layer comprising a second negative type photosensitive resin, the first negative type photosensitive resin being one of a solvent soluble resin and an alkali soluble resin, the second negative type photosensitive resin being the other one of the solvent soluble resin and the alkali soluble resin.

25. The method according to claim 22, wherein the crosslink inhibitor is a light absorbing dye that comprises at least one material selected from the group consisting of benzophenone compounds, salicylic acid compounds, phenylacrylate compounds, benzotriazole compounds, coumarin compounds and thioxanthone compounds.

* * * * *